US010039991B2

(12) United States Patent
Fernandez et al.

(10) Patent No.: US 10,039,991 B2
(45) Date of Patent: Aug. 7, 2018

(54) DIDACTIC SET OF PIECES FOR ASSEMBLING STRUCTURES

(71) Applicants: Eduardo Roberto Fernandez, Lanús-Pcia. de Buenos Aires (AR); Nicolás Javier Di Prinzio, Quilmes-Pcia. de buenos Aires (AR)

(72) Inventors: Eduardo Roberto Fernandez, Lanús-Pcia. de Buenos Aires (AR); Nicolás Javier Di Prinzio, Quilmes-Pcia. de buenos Aires (AR)

( * ) Notice: Subject to any disclaimer, the term of this patent is extended or adjusted under 35 U.S.C. 154(b) by 0 days.

(21) Appl. No.: 15/133,645

(22) Filed: Apr. 20, 2016

(65) Prior Publication Data

US 2016/0317939 A1 Nov. 3, 2016

(30) Foreign Application Priority Data

Apr. 21, 2015 (AR) ..... M20150101201

(51) Int. Cl.
*A63H 33/08* (2006.01)

(52) U.S. Cl.
CPC ..... *A63H 33/084* (2013.01)

(58) Field of Classification Search
CPC ..... A63H 33/08; A63H 33/084
See application file for complete search history.

(56) References Cited

U.S. PATENT DOCUMENTS

| | | | | | |
|---|---|---|---|---|---|
| 1,163,851 | A * | 12/1915 | Pringle | A63H 33/044 | 446/106 |
| 1,271,160 | A * | 7/1918 | Groves | A63H 33/044 | 446/106 |
| 1,311,337 | A * | 7/1919 | Fredson | A63H 33/06 | 446/114 |
| 1,574,191 | A * | 2/1926 | Groves | A63H 33/06 | 446/106 |
| 2,104,742 | A * | 1/1938 | Fleischer | A63H 33/06 | 446/106 |
| 2,633,662 | A * | 4/1953 | Nelson | A63H 33/06 | 376/459 |
| 2,712,200 | A * | 7/1955 | Dearling | A63H 33/06 | 193/25 E |
| 4,740,188 | A * | 4/1988 | Coster | A63H 33/067 | 446/106 |
| 5,853,313 | A * | 12/1998 | Zheng | A63H 33/065 | 403/345 |
| 2010/0323580 | A1* | 12/2010 | Mayor | A63H 33/084 | 446/106 |
| 2014/0220853 | A1* | 8/2014 | Draghicescu | A63H 33/084 | 446/108 |

* cited by examiner

*Primary Examiner* — John Ricci
(74) *Attorney, Agent, or Firm* — Robert E. Bushnell, Esq.

(57) ABSTRACT

The present invention relates to a didactic set of pieces for assembling structures, which comprises pieces (1)(2)(3) of optional usage for assembling structures with didactic purposes, comprising compatible assembly pieces (1)(2)(3) and provided with means of reciprocal assembly (4)(5)(16) that, assembled between each other, are able to form structures. It comprises a basic set (1) of pieces (1*a*)(1*b*)(1*c*)(1*d*)(1*e*)(1*f*) which assembly slots (4)(5) are open on any or all the sides (11)(12)(13)(14) comprising the piece perimeter.

7 Claims, 15 Drawing Sheets

DIDACTIC SET OF PIECES FOR ASSEMBLING STRUCTURES

FIELD OF THE INVENTION

The present invention is related to the field of the current needs of life and to the toys for the construction of structures.

More particularly, it consists of a set in which the pieces contain slots on certain placements, so that the great number of options encourages the user's creativity and enables their didactic stimulation.

PRIOR ART

Up to date, numerous components and sets integrated by different pieces are known to allow the assembly of structures.

For example, U.S. Pat. No. 3,855,748 discloses an assembly set with two types of pieces: square with straight slots and square with oblique slots at the corners. In none of these cases, there is a combination of options, something that limits the options.

U.S. Pat. No. 5,827,104 shows the pieces of a construction toy wherein there is a combination of straight slots, oblique slots, straight edges and curved edges. The shapes of the pieces are very specific and focused on the construction of animal shapes.

U.S. Pat. No. 7,469,898 discloses a puzzle comprised by a plurality of flat square and rectangular elements, with oblique slots, that may be placed either on the corners or on the long sides of said pieces. In this proposed version, there are very few construction options.

DRAWINGS

For better clarity and understanding of the object of the invention, it is illustrated with several figures where it has been represented in one of its preferred embodiments, everything as an illustrative example, without limitation:

FIG. 3 comprises:

A front elevated view of a first laminar rectangular piece;

A top elevated view of said first laminar rectangular piece; and

A side elevated view of said first laminar rectangular piece.

FIG. 4 comprises:

A front elevated view of a second laminar rectangular piece;

A top elevated view of said second laminar rectangular piece; and

A side elevated view of said second laminar rectangular piece.

FIG. 5 comprises:

A front elevated view of a third laminar rectangular piece;

A top elevated view of said third laminar rectangular piece; and

A side elevated view of said third laminar rectangular piece.

FIG. 6 comprises:

A front elevated view of a fourth laminar rectangular piece;

A top elevated view of said fourth laminar rectangular piece; and

A side elevated view of said fourth laminar rectangular piece.

FIG. 7 comprises:

A front elevated view of a fifth laminar rectangular piece;

A top elevated view of said fifth laminar rectangular piece; and

A side elevated view of said fifth laminar rectangular piece.

FIG. 8 comprises:

A front elevated view of a sixth laminar rectangular piece;

A top elevated view of said sixth laminar rectangular piece; and

A side elevated view of said sixth laminar rectangular piece.

FIG. 9 comprises:

A front elevated view of a laminar crossbar piece;

A top elevated view of said laminar crossbar piece; and

A side elevated view of said laminar crossbar piece.

Figure 1:
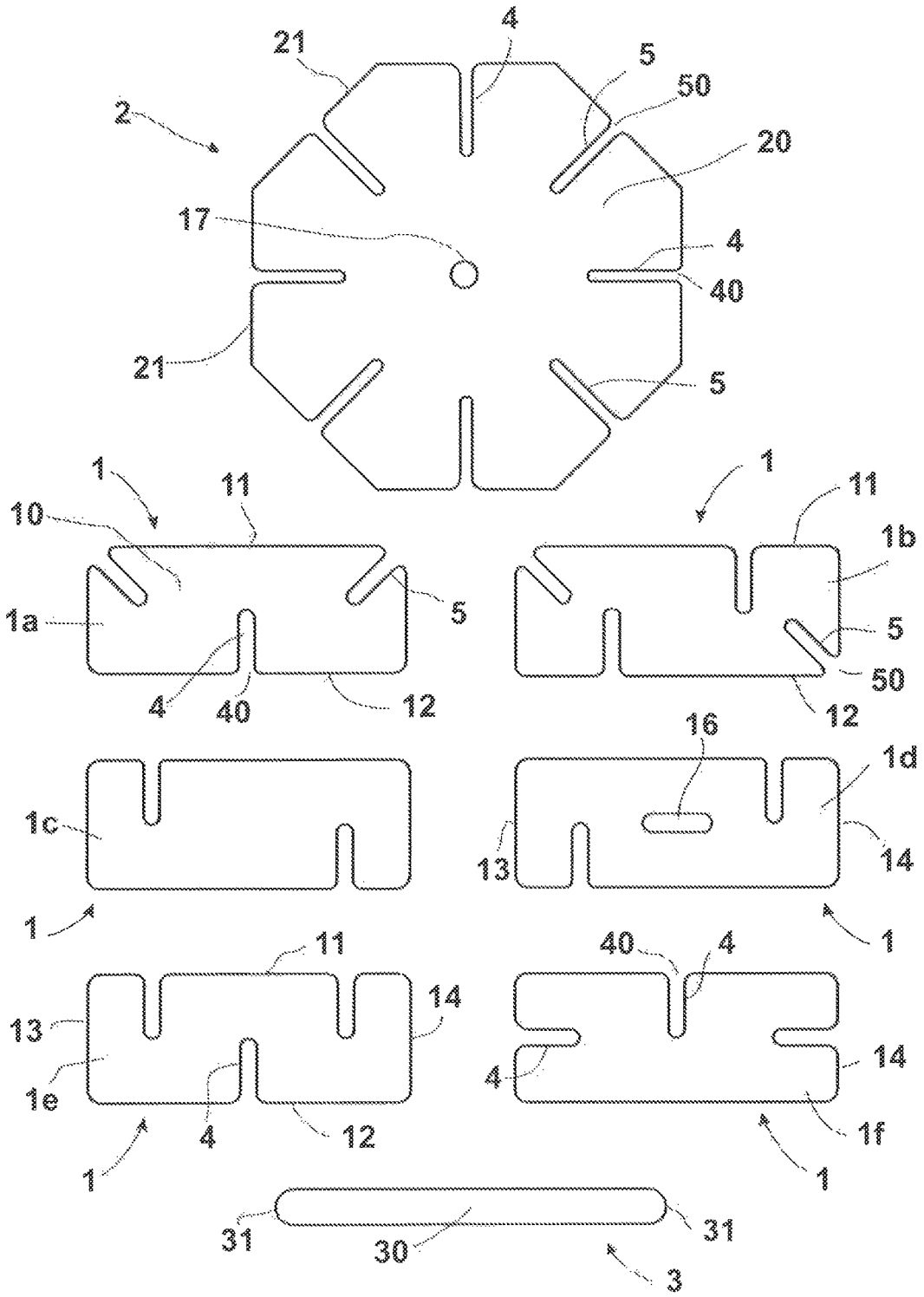
FIG. 1 is a front elevation view of a set containing different options of pieces.
Figure 2:
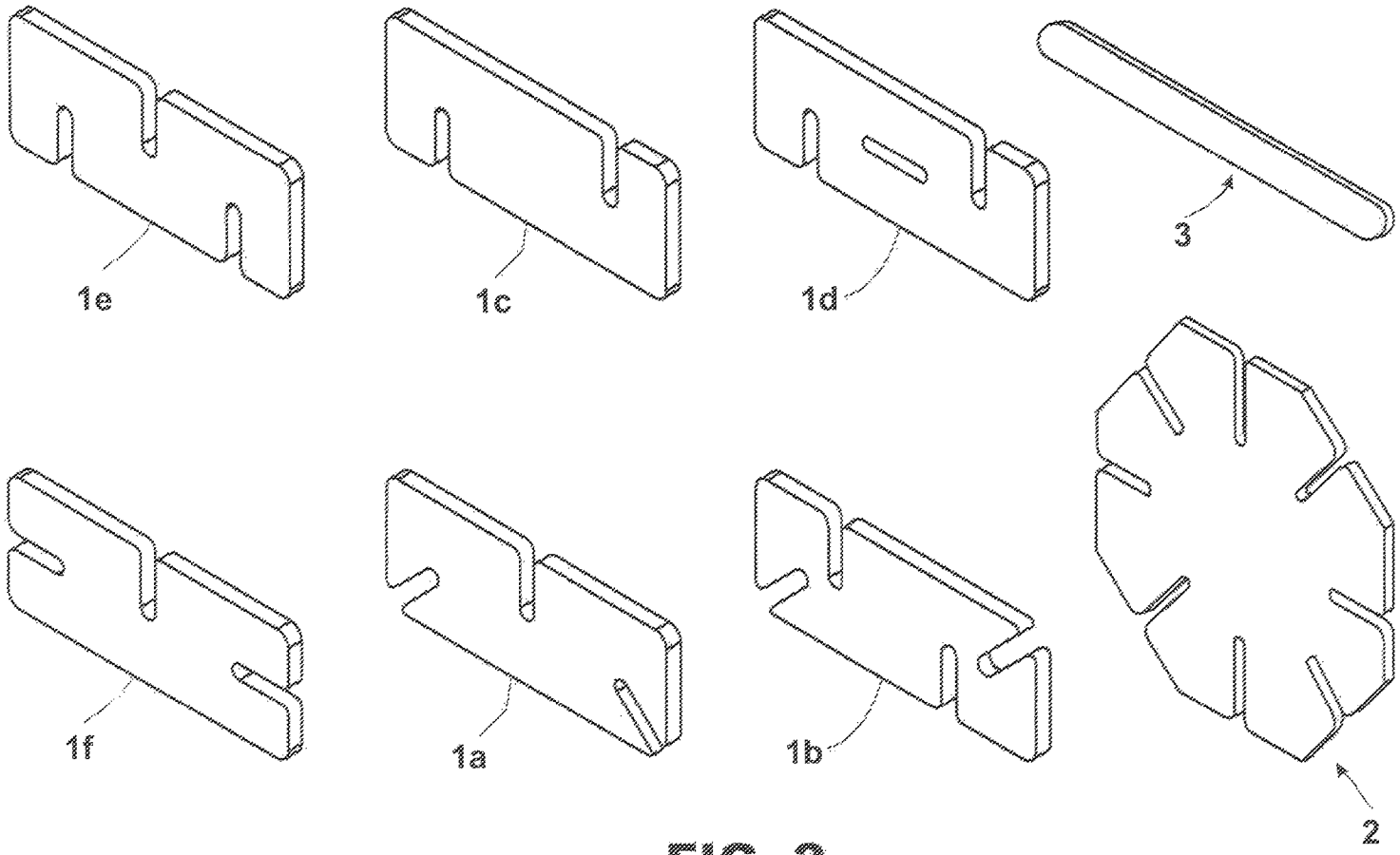
FIG. 2 is a perspective view of the set containing different options of pieces.
Figure 3:
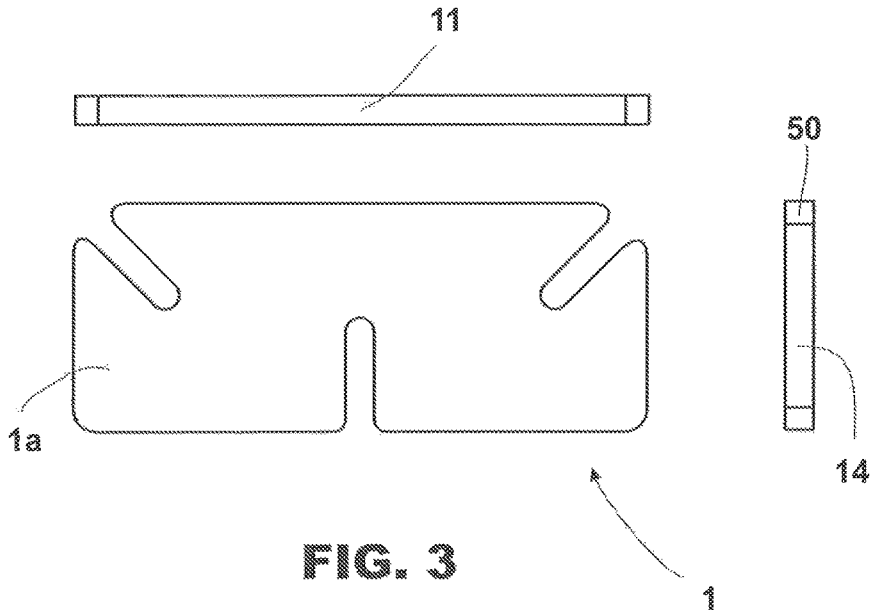
Figure 4:
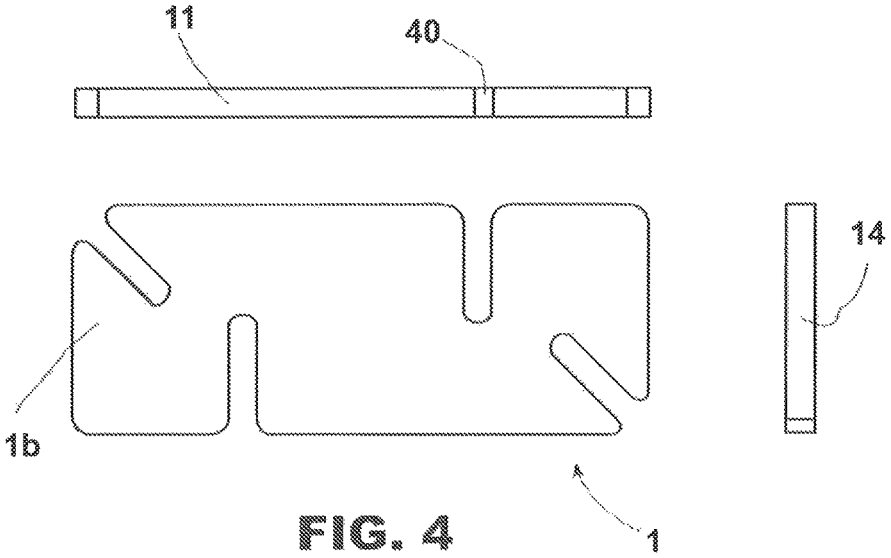
Figure 5:
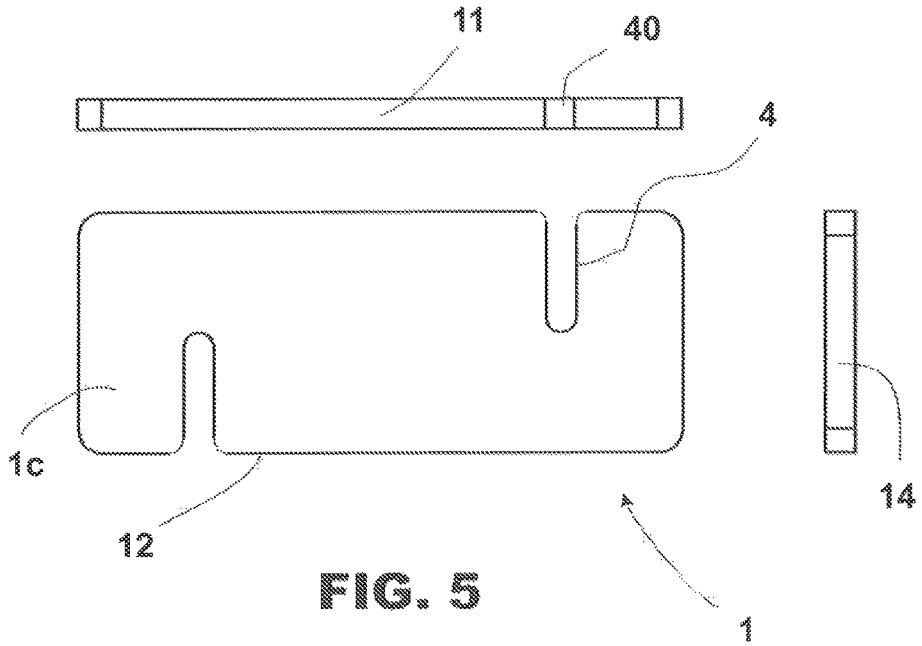
Figure 6:
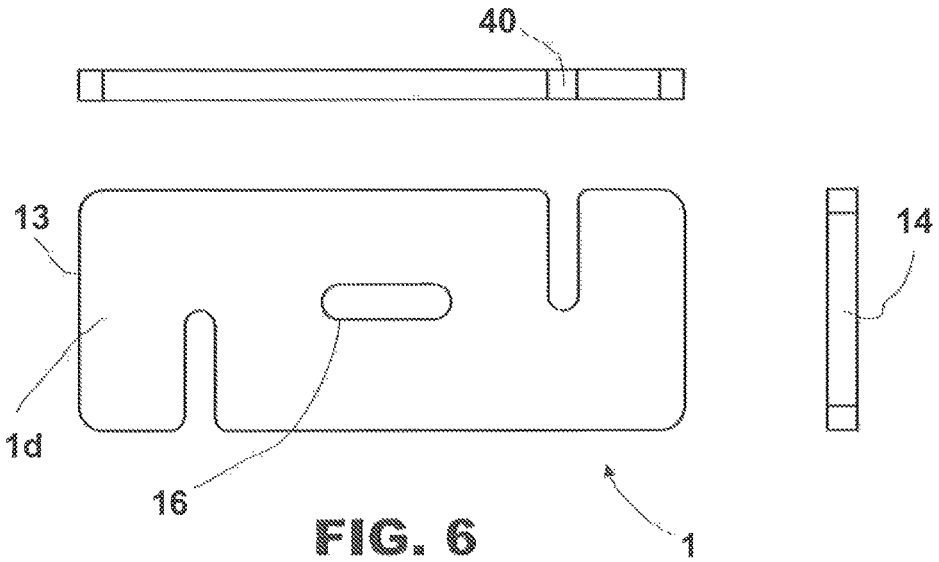
Figure 7:
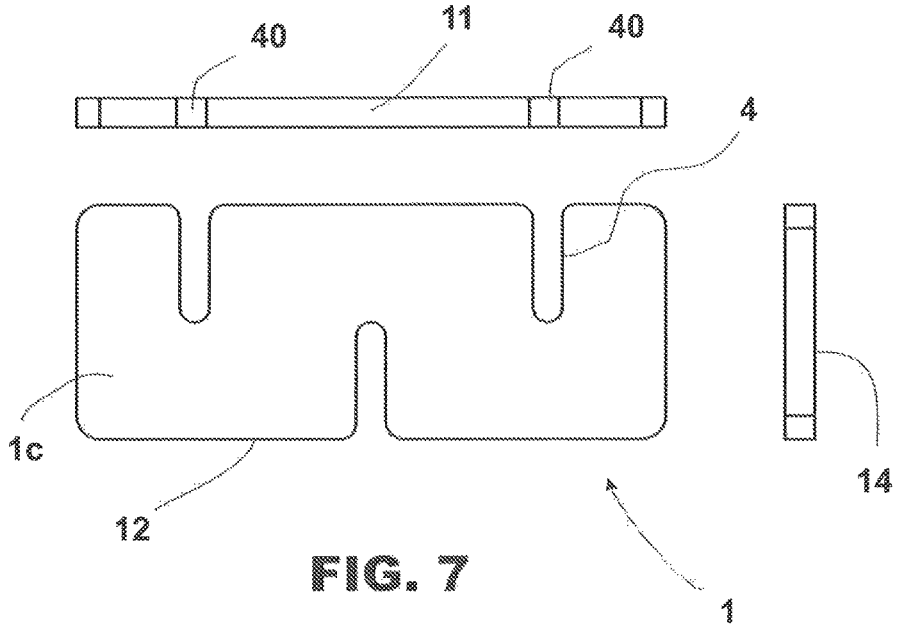
Figure 8:
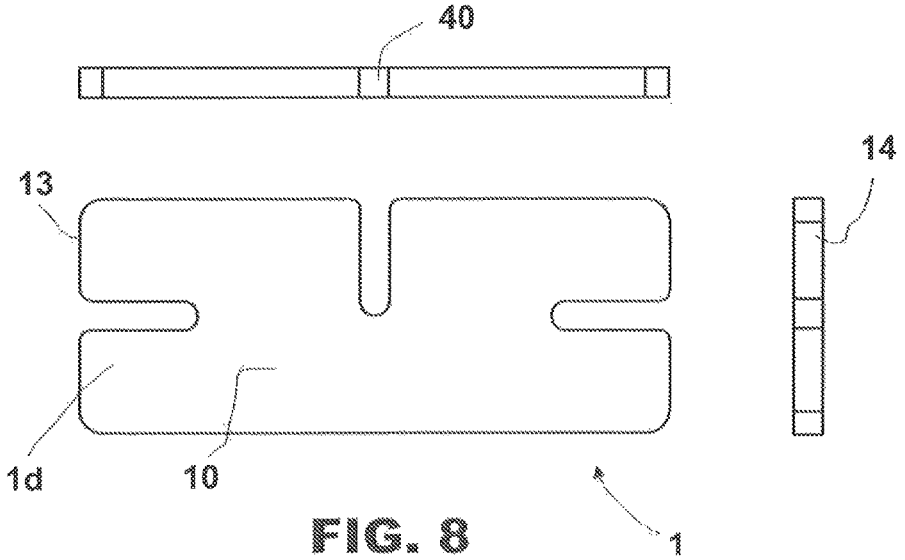
Figure 9:
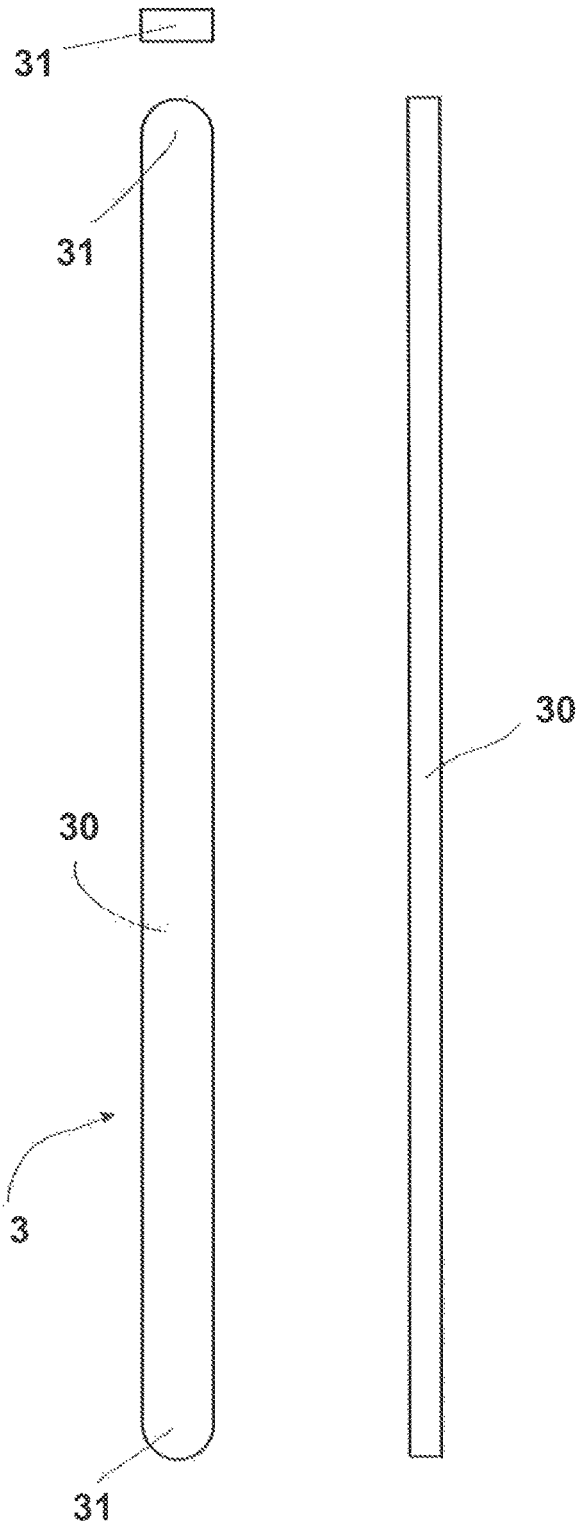
Figure 10:
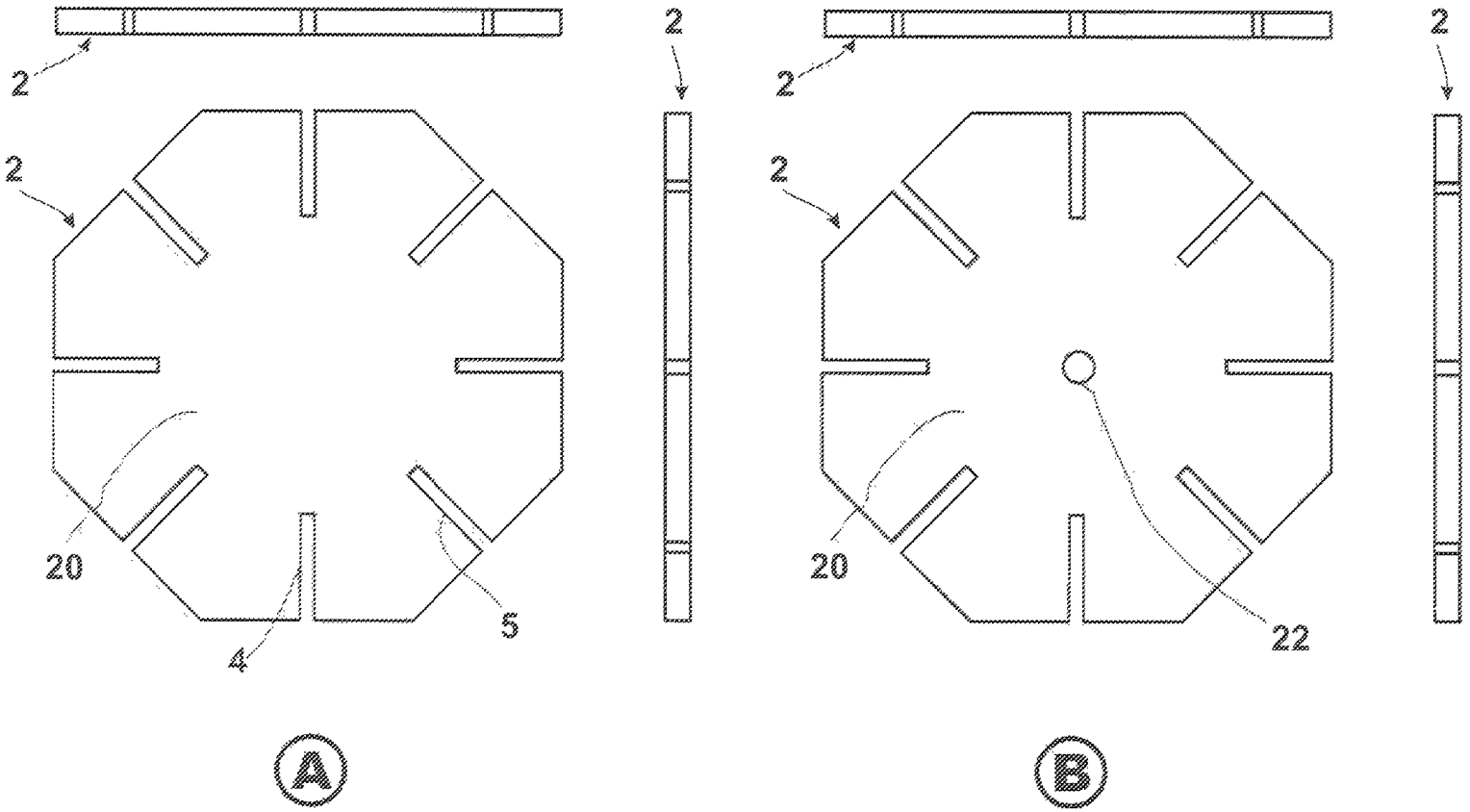

FIG. 10 comprises the set of drawings A and B, wherein:

The set of drawings A comprises: a front elevated view of a laminar multilateral piece, a top elevated view of said multilateral piece and a side elevated view of said multilateral piece; and The set of drawings B comprises: a front, elevated view of a laminar multilateral piece with a central opening, a top elevated view of said multilateral piece, and a side elevated view of said multilateral piece.

Figure 11:
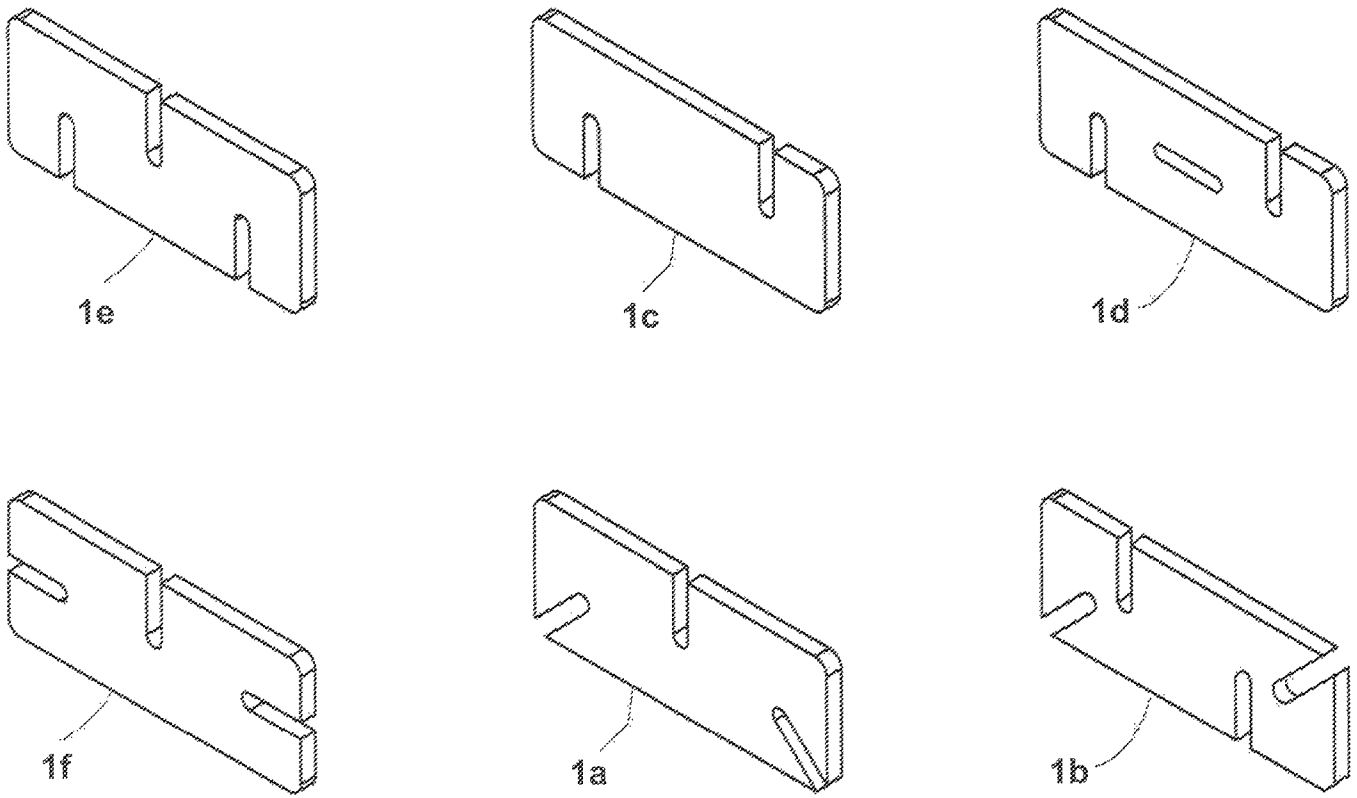

FIG. 11 comprises six perspective views of both options of laminar rectangular pieces.

Figure 12:
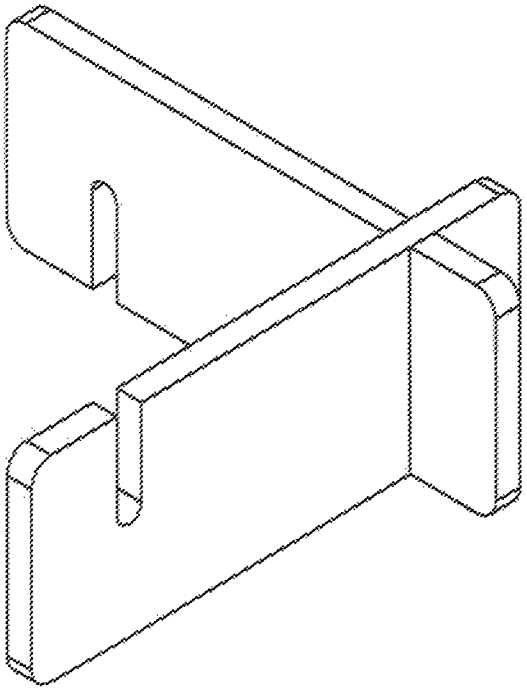

FIG. 12 is a perspective view of two assembled rectangular pieces.

Figure 13:
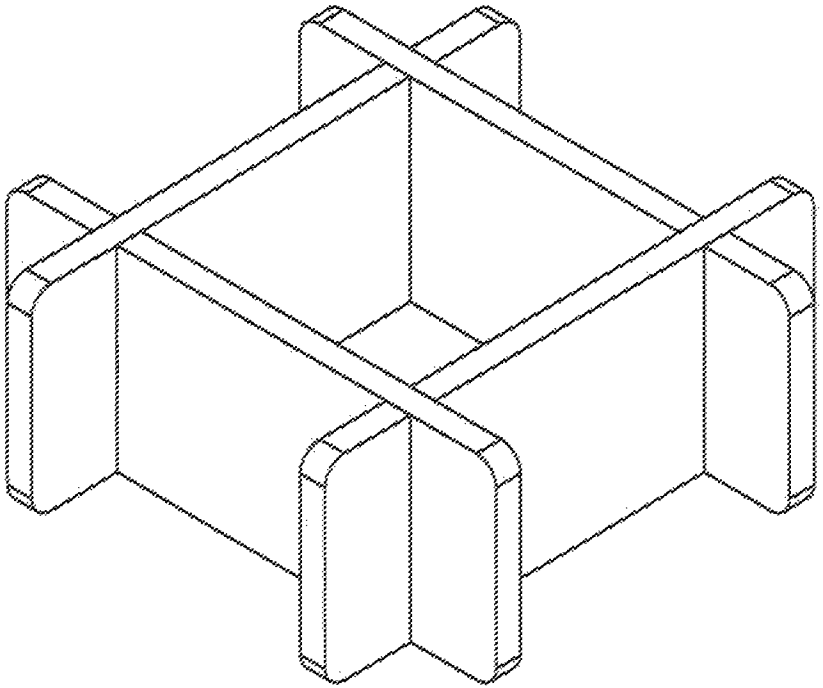

FIG. 13 is a perspective view of four assembled rectangular pieces forming a basic structure.

Figure 14:
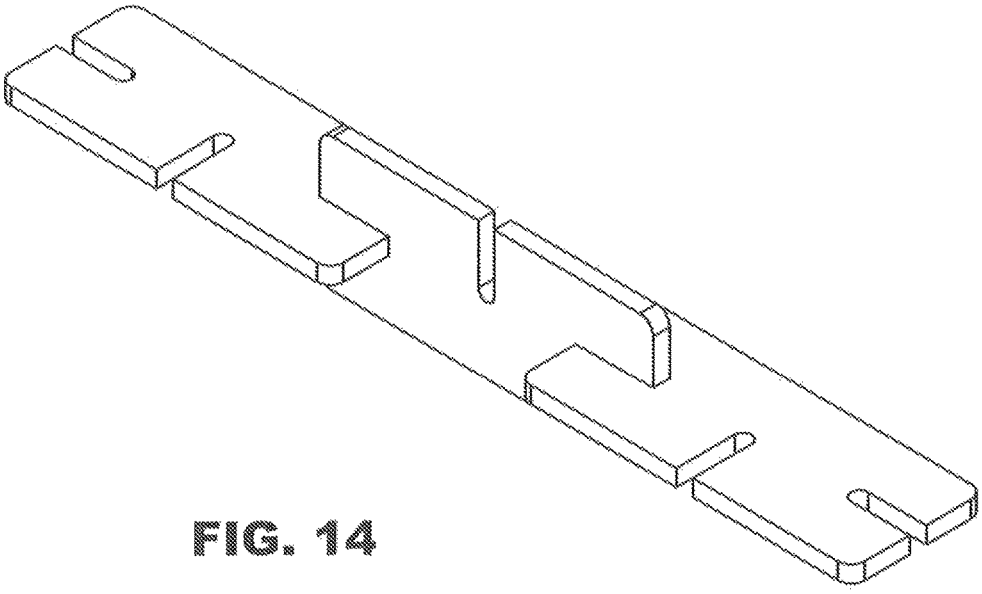

FIG. 14 is a perspective view of three assembled rectangular pieces forming a linear basic structure.

Figure 15:
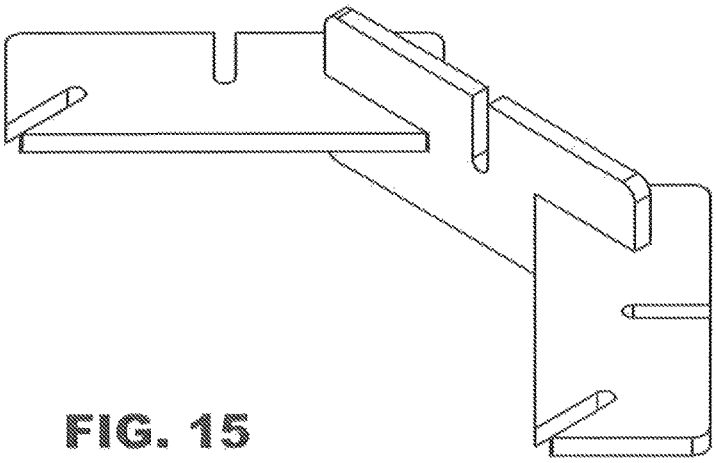

FIG. 15 is a perspective view of three assembled rectangular pieces forming a misaligned basic structure.

Figure 16:
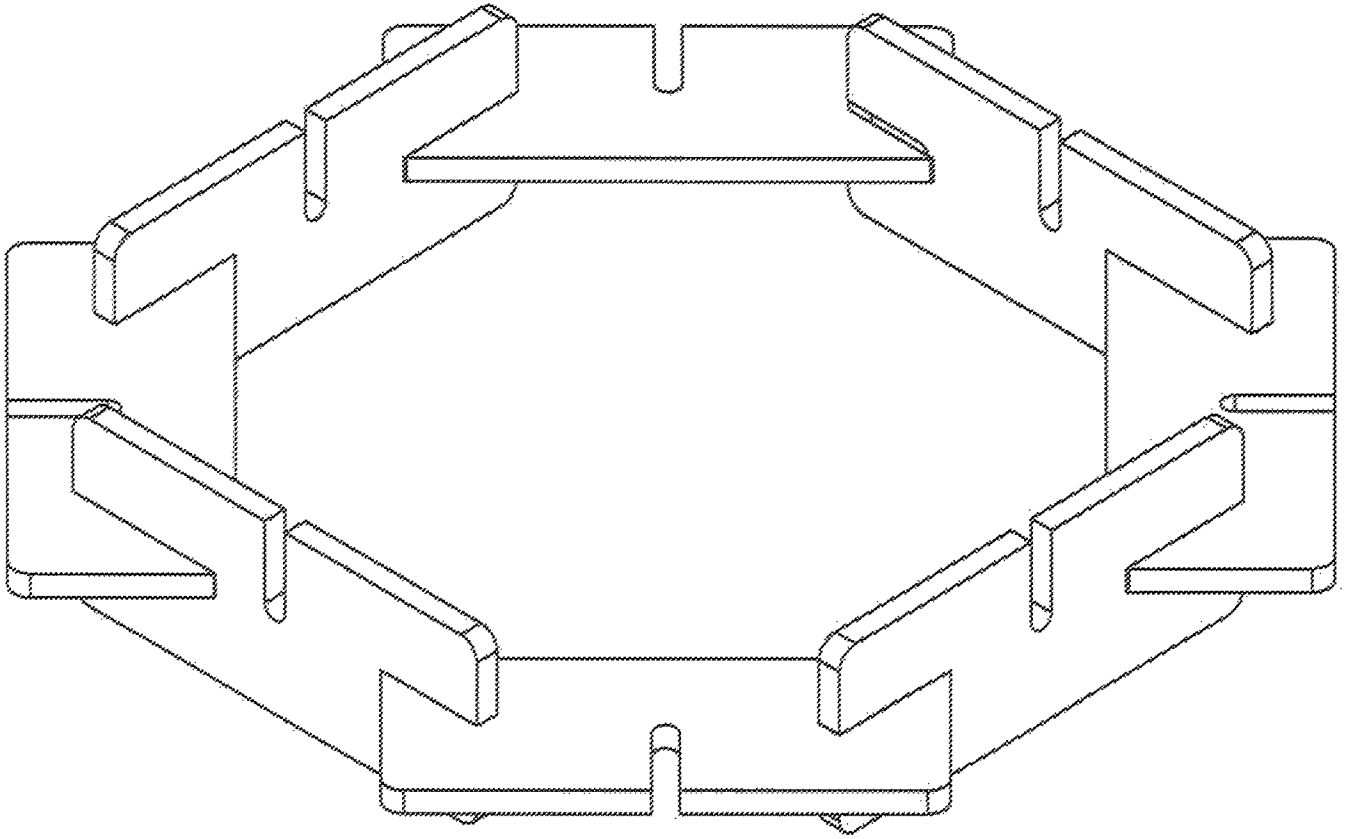

FIG. 16 is a perspective view of eight assembled rectangular pieces forming a closed structure.

Figure 17:
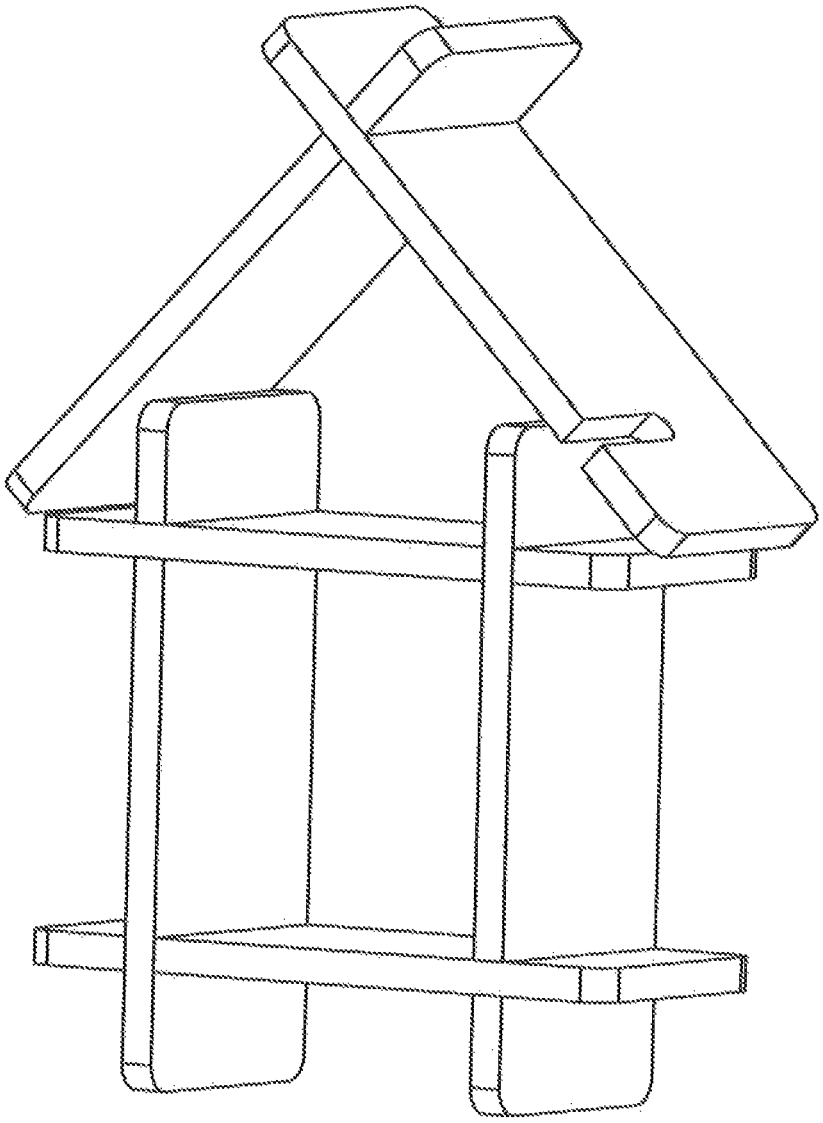

FIG. 17 is a perspective view of six assembled rectangular pieces forming a structure.

Figure 18:
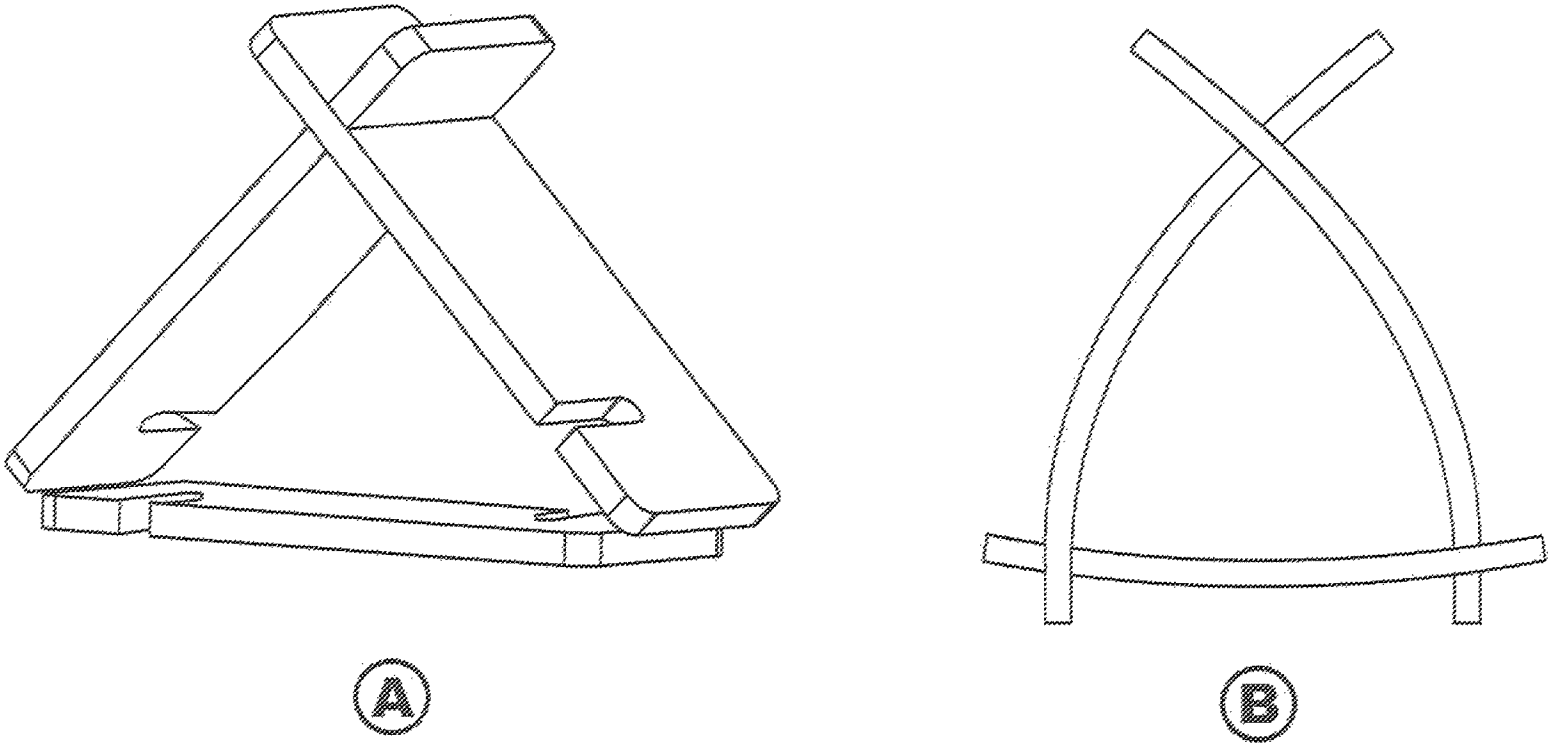

FIG. 18 comprises drawings A and B, wherein:

Drawing A is a perspective view showing the assembly position of 3 pieces and

Drawing B is a side elevated view which shows how the inner walls of the slots and the plate thickness determine a position that, combined with the deformation capability, allows obtaining curved assemblies.

Figure 19:
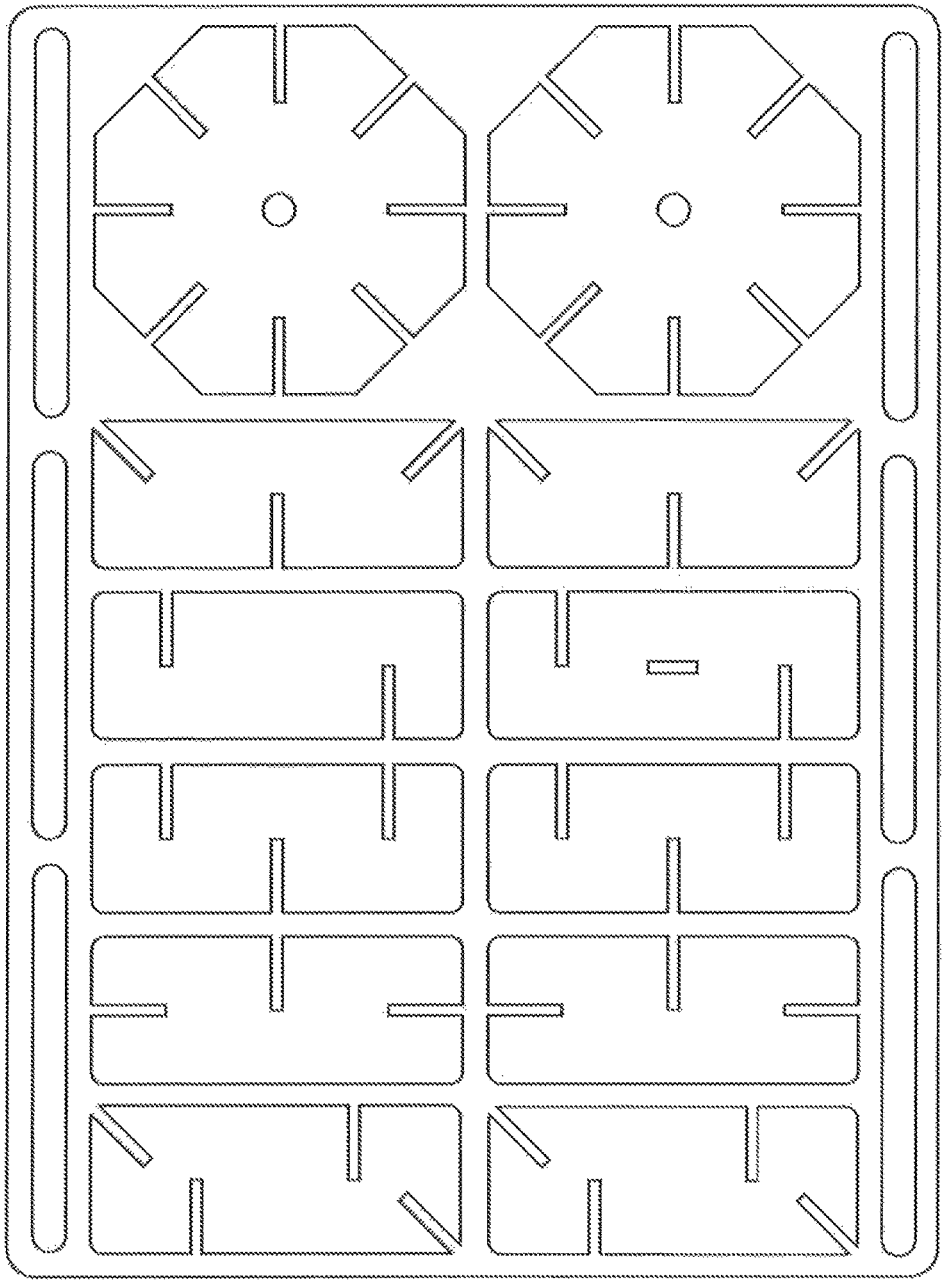

FIG. 19 is a front elevated view of a die cut set of laminar pieces, inserted into the die cut cavities.

Figure 20:
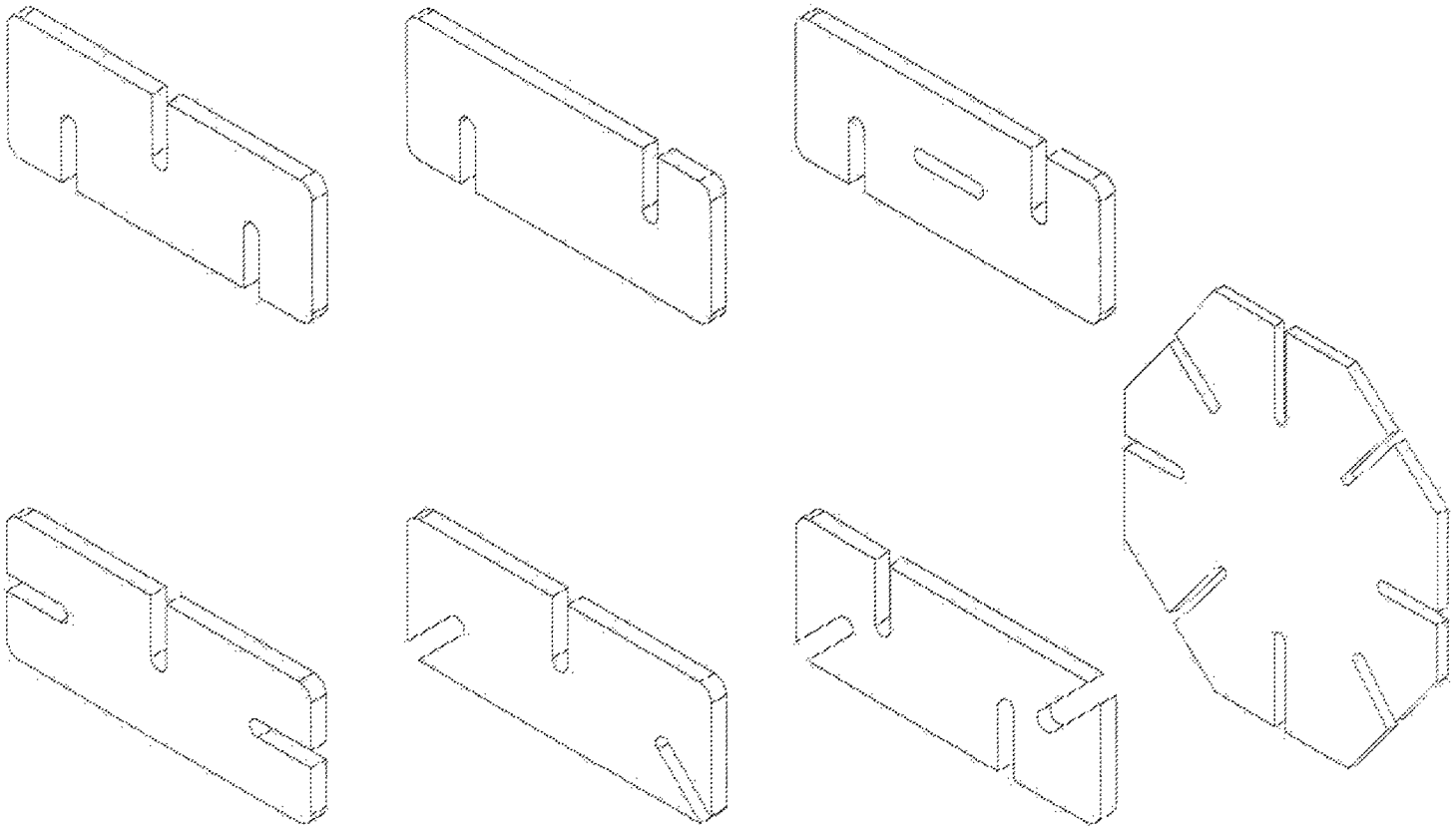

FIG. 20 is a perspective view of a set which pieces have a rounded bottom of the slots.

In the different figures, the same numbers and/or reference letters indicate equal or corresponding parts.

LIST OF THE MAIN REFERENCES (1) Rectangular pieces.
(1*a*) First rectangular piece.
(1*b*) Second rectangular piece,
(1*c*) Third rectangular piece.
(1*d*) Fourth rectangular piece.
(1*e*) Fifth rectangular piece.
(1*f*) Sixth rectangular piece.
(10) Rectangular body of the rectangular pieces (1).

(11) First long external side.
(12) Second long external side.
(13) First short external side.
(14) Second short external side.
(15) Corners,
(16) Transverse slots.
(17) Central opening.
(2) Multilateral piece.
(20) Multilateral laminar body of the multilateral piece (2).
(21) Multiple external sides.
(22) Central opening on the multilateral piece (2).
(3) Crossbar piece.
(4) Perpendicular assembly slots.
(40) Perpendicular external opening,
(5) Oblique assembly slots.
(50) Oblique external opening.

DESCRIPTION

The present invention is related to a didactic set of pieces for assembling structures, which comprises pieces (1)(2)(3) for optional usage for assembling structures with didatic purposes, comprising compatible assembly pieces (1)(2)(3) and provided with means of reciprocal assembly (4)(5)(16) that, assembled between each other, are able to form structures.

DETAILED DESCRIPTION

More particularly, it comprises a basic set (1) of pieces (1*a*)(1*b*)(1*c*)(1*d*)(1*e*)(1*f*) which, although preferably presenting rounded corners (15), are substantially rectangular, in the sense of their long external sides (11)(12) and short sides (13)(14).

Each of these rectangular pieces (1) comprises a set of assembly slots (4)(5) which are open on any of all the sides (11)(12)(13)(14) that comprise the perimeter of the piece.

These assembly slots (4)(5) comprise perpendicular assembly open slots (4), as well as oblique assembly open slots (5), arranged so that the rectangular pieces (1) are able to assemble between each other, or even with other supplementary pieces (2)(3) or elements, until forming structures.

The body of each piece (1) is formed by at least a corresponding deformable plate. This capability of the body of the pieces (1)(2)(3) is due to the fact that the pieces are structured in a relatively deformable material. For this reason, materials such as a thermoplastic polymer like Ethylene Vinyl-Acetate, or any other with equivalent properties regarding the desired effect can be used. Thus, light pieces are obtained, which do not hurt the user and that may loose shape to adapt to said user's creativity, usually children.

Concerning the slots (4)(5)(16), the pieces (1)(2)(3) may also have transverse slots (16) which pass through the body of the rectangular piece (1), for example, outside their external or peripheral sides (11)(12)(13)(14). They allow the assembly with elements such as crossbar pieces (3).

On the other hand, the assembly slots (4)(5) may have a length equivalent to, at the utmost, half the short side (13)(14) of the rectangular piece (1).

In addition, it has been considered to have oblique assembly slots (5) open on the corners (15) of the rectangular pieces (1).

One of the rectangular pieces (1*e*) comprises a set of open perpendicular assembly slots (4) which comprise:

Two open slots (4) on one of the long sides (11)(12) of the rectangular piece (1*e*).

An open slot (4) on the opposite long side (12)(11) of the rectangular piece (1); and The longitudinal axis of the open slot (4) on the opposite long side (12)(11) is equidistant to the longitudinal axes of the open slots on the long side (11)(12).

Another rectangular piece (1*f*) comprises a set of perpendicular open assembly slots (4) which comprise:

Both open slots (4) on the opposite short sides (13)(14) of the rectangular piece (1*f*); and An open slot (4) on one of the long sides (11)(12) of said rectangular piece (10.

A further rectangular piece (1*a*) comprises a set of open assembly slots (4)(5) which comprise:

Two oblique assembly open slots (5) which open at both corners (15); and At least a perpendicular assembly open slot (4).

Another rectangular piece (1*a*) comprises a set of assembly open slots (4)(5) which comprise:

Two oblique assembly open slots (5) which open at both corners (15) of the same external or peripheral long side (11)(12) of the rectangular body; and A perpendicular assembly open slot (4) which opens on the opposite long side (12)(11).

Another rectangular piece (1*b*) comprises a set of assembly open slots (4)(5) which comprise:

Two oblique assembly open slots (5) which open on each opposite corner (15) of the rectangular body.

Two perpendicular assembly open slots (4) which open on both long sides (11)(12); and Each perpendicular assembly open slot (4) opens on the same long side (11)(12) of the oblique assembly slots (5), both slots (4)(5) being apart by a distance longer than half the long side (11)(12) on which they open.

It has been considered the possibility that the present set includes a multilateral piece (2) with polygonal contour provided with an open assembly slot (4) per each side (21) of said polygonal contour. Each assembly slot (4) may be perpendicular respect to its side (20) and, at the same time, oblique (5) respect to the adjacent side (4).

With regard to its shape, the multilateral piece (2) may be octagonal. It has also been considered the possibility that this multilateral piece (2) contains a central opening (17) for the assembly of an axis.

In another embodiment, the present set of pieces (1)(2)(3) may be provided with a die cast of pieces that, removingly fitted in their respective die casts, comprise:

A set of rectangular pieces (1*f*) which comprise: a perpendicular assembly open slot (4) on each of their short sides (13)(14) and a perpendicular assembly open slot (4) on one of their short sides (11)(12);

A set of rectangular pieces (1*e*) which comprises: a perpendicular assembly open slot (4) on one of their long sides (11)(12) and two perpendicular assembly open slots (4) on the opposite long side (12)(11);

A set of rectangular pieces (1*d*) which comprises: a perpendicular assembly open slot (4) on one of their long sides (11)(12), a perpendicular assembly open slot (4) on the opposite long side (12)(11) and a transverse slot (16) on the central part of the piece;

A set of rectangular pieces (1*a*) which comprises: two oblique assembly open slots (5) which open on each corner (15) determined by the same peripheral long side (11)(12) of the rectangular body and a perpendicular assembly open slot (4) which opens on the opposite long side (12)(11).

A set of rectangular pieces (1*b*) which comprises: two oblique assembly open slots (5) which open on each opposite corner (15) of the rectangular body, two perpendicular assembly open slots (4) which open on each long side (11)(12) and each perpendicular assembly open slot (4) opens on the same long side (11)(12) of one of the oblique assembly slots (5), both slots (4)(5) being apart by a distance longer than half the long side (11)(12) on which they open; and A set of crossbars (3) able to pass through transverse slots (16).

The multilateral piece (2) may comprise an open assembly slot (4)(5). Each open slot (4)(5) is, on the one hand, perpendicular (4) to its side of the octagonal contour and, on the other hand, oblique (5) respect to the adjacent slots.

On the other hand, even though the plates that comprise the pieces (1)(2)(3) may be deformable/flexible, this does not prevent the inner edges of the slots (4)(5) and the thickness of the plate forming the body of each piece, from being the ones that determine the angular position of the pieces (1)(2)(3) that assemble on said slots (4)(5).

Thus, the match between the inner edges of the slots (4)(5) and the thickness of the plate forming the body of each piece (1)(2)(3), on the one hand, and the position of the slots (4)(5) on the bodies of the pieces (1)(2)(3), on the other hand, may determine the deformation [e.g., the warp of the assembled pieces, as shown in drawing B of FIG. 18].

Undoubtedly, upon putting the present invention into practice, modifications may be introduced regarding certain construction details and form, without leaving the essential principles that are clearly explained in the claims below:

We claim:

1. A DIDACTIC SET OF PIECES FOR ASSEMBLING STRUCTURES for assembling structures with didactic purposes, comprising:

compatible assembly pieces configured to be assembled with each other and form the structures, wherein the compatible assembly pieces comprises:

a plurality of substantially rectangular pieces, each of the plurality of substantially rectangular pieces comprises a plurality of assembly slots that are open in the perimeter of the each of the plurality of substantially rectangular pieces, the plurality of assembly slots comprise perpendicular assembly open slots and oblique assembly open slots; and on the plurality of substantially rectangular pieces, the plurality of assembly slots are arranged such that the rectangular pieces are able to assemble, at least, between each other, until forming the structures, wherein the rectangular piece comprises a set of perpendicular assembly open slots which comprise:

two open slots on one of the long sides of the rectangular piece, one open slot on the opposite long side of the rectangular piece; and the longitudinal axis of the open slot on the opposite long side is equidistant to the longitudinal axes of the open slots on the long side.

2. A DIDACTIC SET OF PIECES FOR ASSEMBLING STRUCTURES for assembling structures with didactic purposes, comprising:

compatible assembly pieces configured to be assembled with each other and form the structures, wherein the compatible assembly pieces comprises:

a plurality of substantially rectangular pieces, each of the plurality of substantially rectangular pieces comprises a plurality of assembly slots that are open in the perimeter of the each of the plurality of substantially rectangular pieces, the plurality of assembly slots comprise perpendicular assembly open slots and oblique assembly open slots; and on the plurality of substantially rectangular pieces, the plurality of assembly slots are arranged such that the rectangular pieces are able to assemble, at least, between each other, until forming the structures, the didactic set further comprises a die cast set of the compatible assembly pieces which, removingly fitted in their corresponding die casts, comprise:

a set of rectangular pieces which comprise: a perpendicular assembly open slot on each of their short sides and a perpendicular assembly open slot on one of their long sides;

a set of rectangular pieces comprising: a perpendicular assembly open slot on one of their long sides and two perpendicular assembly open slots on the opposite long side;

a set of rectangular pieces comprising: a perpendicular assembly open slot on one of their long sides, a perpendicular assembly open slot on the opposite long side and a transverse slot on the central part of the piece;

a set of rectangular pieces comprising: two oblique assembly open slots which open on each corner determined by the same peripheral long side of the rectangular body and a perpendicular assembly open slot which opens on the opposite long side;

a set of rectangular pieces comprising: two oblique assembly open slots which open on each corner opposite to the rectangular body, two perpendicular assembly open slots which open on each long side and each perpendicular assembly open slot opens on the same long side of one of the oblique assembly slots, both slots being apart by a distance longer than half the long side on which they open; and a set of crossbars able to pass through transverse slots.

3. THE DIDACTIC SET OF PIECES FOR ASSEMBLING STRUCTURES, according to claim 2, wherein the die cast set further comprises a set of multilateral pieces, with each of the pieces comprising an open assembly slot for each side of their octagonal contour.

4. THE DIDACTIC SET OF PIECES FOR ASSEMBLING STRUCTURES, according to claim 2, wherein the pieces are structured in a relatively deformable material.

5. THE DIDACTIC SET OF PIECES FOR ASSEMBLING STRUCTURES, according to claim 4, wherein the relatively deformable material comprises a thermoplastic polymer of the Ethylene Vinyl Acetate type.

6. THE DIDACTIC SET OF PIECES FOR ASSEMBLING STRUCTURES, according to claim 2, wherein the inner edges of the slots and the thickness of the plate comprising the body of each piece, determines the angular position of the pieces that assemble at the slots.

7. THE DIDACTIC SET OF PIECES FOR ASSEMBLING STRUCTURES, according to claim 6, wherein the inner edges of the slots and the thickness of the plate comprising the body of each piece, together with the position of the slots on the bodies of the pieces, determine the warp of the assembled pieces.

* * * * *